United States Patent [19]

Kedjierski et al.

[11] 4,099,168

[45] Jul. 4, 1978

[54] INTRUSION ALARM AND EMERGENCY ILLUMINATION APPARATUS AND METHOD

[75] Inventors: Fred Dennis Kedjierski, Margate; John Bailie, Ft. Lauderdale, both of Fla.

[73] Assignee: Magnum Products, Inc., Ft. Lauderdale, Fla.

[21] Appl. No.: 629,664

[22] Filed: Nov. 6, 1975

[51] Int. Cl.[2] ..... G08B 13/22

[52] U.S. Cl. ..... 340/517; 307/117; 340/566; 340/654

[58] Field of Search ..... 340/258 B, 258 D, 261, 340/224, 276; 307/117; 200/61.01, DIG. 20

[56] References Cited

U.S. PATENT DOCUMENTS

| | | | |
|---|---|---|---|
| 3,665,445 | 5/1972 | Riley, Jr. | 340/261 |
| 3,686,668 | 8/1972 | Durkee | 340/276 |
| 3,713,126 | 1/1973 | Stettner | 340/258 D |
| 3,733,598 | 5/1973 | Kato | 340/258 D |
| 3,761,912 | 9/1973 | Stettner et al. | 340/258 B |
| 3,778,807 | 12/1973 | Ralston | 340/276 |
| 3,914,692 | 10/1975 | Seaborn, Jr. | 340/224 |

*Primary Examiner*—Glen R. Swann, III

*Attorney, Agent, or Firm*—Burns, Doane, Swecker & Mathis

[57] ABSTRACT

An intrusion alarm and emergency illumination apparatus includes an audible alarm and lighting device which are activated by sounds associated with human intrusion into a physical structure. The sounds of intrusion may be differentiated from other sounds by a bandpass digital amplifier and rate of rise detector which receive audio-electrical waveforms from a microphone. A monostable multivibrator and variable resistance element may be employed to select the duration of activation of the lightning device and alarm and may be employed to provide a preselected exit delay permitting an operator to arm the system and leave the premises without having the sounds of his exiting activate the lighting device and alarm. Emergency illumination may be provided by a reserve power system used to energize the lighting device and alarm system during power outages.

18 Claims, 4 Drawing Figures

INTRUSION ALARM AND EMERGENCY ILLUMINATION APPARATUS AND METHOD

BACKGROUND OF THE INVENTION

In recent years violent crimes, crimes of unauthorized entry, and crimes involving damage to real property have increased dramatically. As a consequence, public demand has mounted for burglar alarms and security lighting.

Most conventional burglar alarms require mechanical tripping sensors which must be installed in entrances to the premises. More recently developed systems, such as those shown in the Ott U.S. Pat. No. 3,582,671 and the Stettner U.S. Pat. Nos. 3,713,126, 3,761,912, and 3,764,832, energize building lighting for a short interval in response to audio signals of requisite intensity. Because of their inability to discriminate among audio signals, the systems are effective at times and in environments where background noises and other innocent noises have a sufficiently low intensity to permit their discrimination from the noises of forceable intrusion (typically, pops, clicks, sounds of impacts and sounds of breaking glass, wood or metal). The systems depend on external sources of power, and are, therefore, inoperative during power outages. The need for an alarm system and lighting system is greatest at those times when power outages occur and at those times when authorized persons are on the premises making innocent background noises.

Conventional systems triggered by a low voltage, low power signal source such as a microphone, employ costly high voltage, high power triacs or SCRs triggered by discrete transistors to perform their activation functions. The systems lack versatility in that they are only capable of performing a single switching function in response to the signal of single type of sensor, e.g. the signal from an array of mechanical switches, microphones, etc.

Accordingly, it is a primary object of the present invention to provide an intrusion alarm capable of detecting noises associated with forceable intrusion into physical premises.

Another object of the present invention is to incorporate an emergency lighting system and an audible alarm into an apparatus operative to activate both the lighting system and audible alarm or only the lighting system in response to noises associated with forceable intrusion into the physical premises, and operative to provide emergency lighting during power outages.

Yet another object of the present invention is to provide an audio detection apparatus capable of differentiating between normal background noises such as aircraft and traffic sounds, i.e., noises with waveforms having slow rise times, and noises associated with forceable intrusion such as clicks, pops, and sounds of impacts, shattering glass, etc. i.e., noises with waveforms having high amplitudes, fast rise times and frequencies in the mid-audio range.

A further object of the present invention is to provide a sound activated alarm system having a monostable or one-shot multivibrator delay circuit and variable resistance elements which may be employed to select the duration of activation of an audible alarm in response to noise and which may be employed to provide a preselected exit delay to permit an operator to arm the system and leave the premises without activating the alarm.

A further object of the present invention is to provide an inexpensive fabricated intrusion alarm including integrated circuit inverters utilized for audio signal filtering and amplification.

Yet a further object of the present invention is to provide an inexpensively fabricated intrusion alarm having selectable exit delay and alarm duration controls incorporated into a circuit employing logic gates as its active elements.

These and other objects and features of the invention will become apparent from the claims and from the following description when read in conjunction with the appended drawings.

DETAILED DESCRIPTION

In accordance with the present invention an intrusion alarm and emergency illumination apparatus is provided which includes an audible alarm and lighting device. Sounds associated with human intrusion into a physical structure may activate the audible alarm, lighting device or produce other indicia that such sounds have been detected. The sounds of intrusion may be differentiated from other sounds by a band pass digital amplifier and rate of rise detector which receive audio-electrical waveforms from a microphone. A monostable multivibrator and variable resistance elements may be employed to select the duration of activation of the lighting device and alarm, and may be employed to provide a preselected exit delay permitting an operator to arm the system and leave the premises without activating the lighting device and alarm. Emergency illumination may be provided by a reserve power system used to energize the lighting device during power outages.

Figure 1:
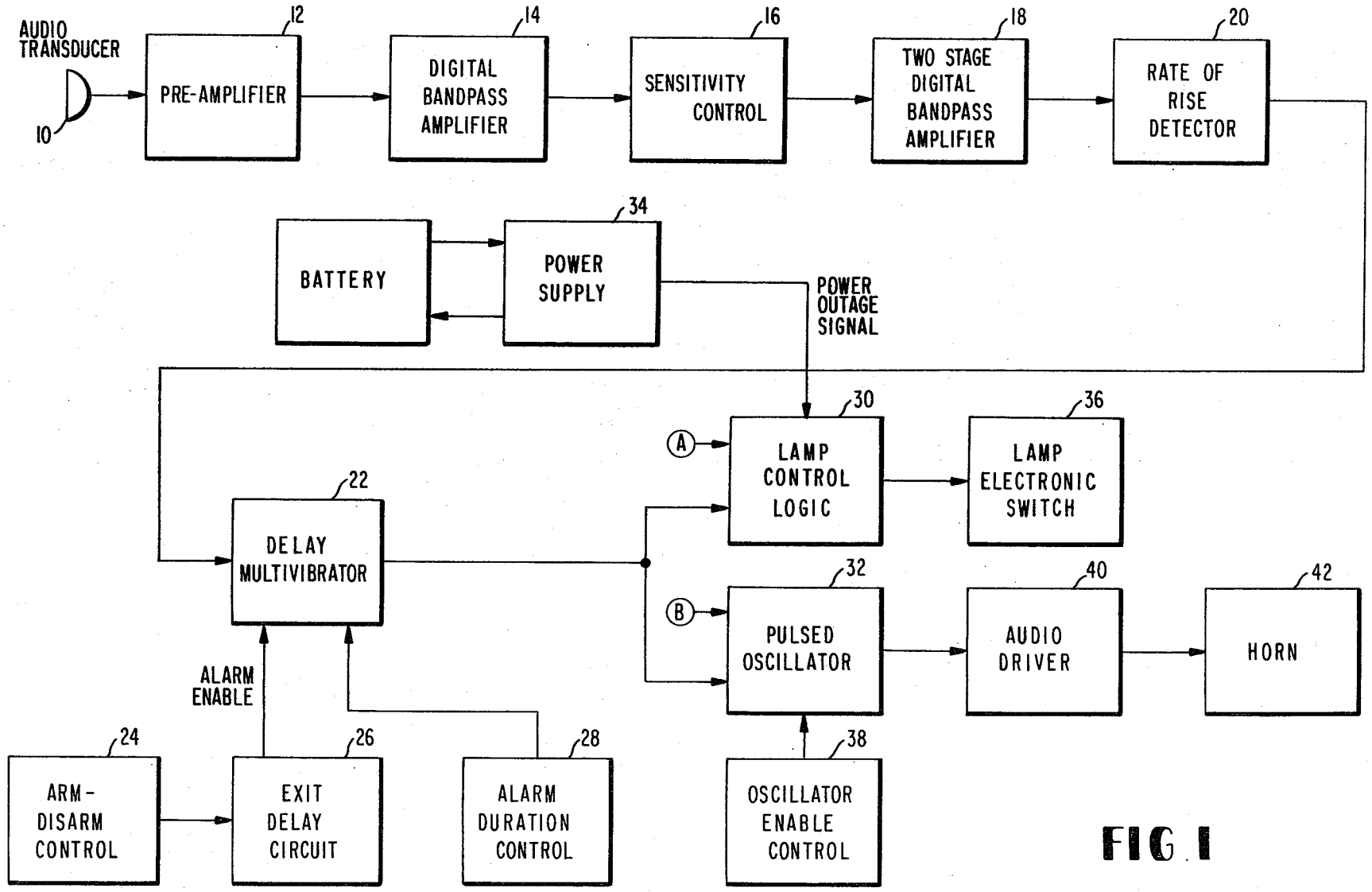
FIG. 1 is a block diagram of one embodiment of the intrusion alarm and emergency illumination apparatus of the present invention.

Referring to FIG. 1, where a block diagram of one embodiment of the present invention is depicted, an audio transducer 10 may be provided to receive ambient sounds in a physical structure such as a building, construction site, etc. The transducer may produce an audio-electrical output waveform in response to sounds impinging on it. The electrical output waveform may be amplified by preamplifier 12 and digital band-pass amplifier 14. The digital band-pass amplifier 14 may be operative to discriminate between audio frequencies and to amplify signals with frequencies associated with the sounds of physical intrusion into the premises. A sensitivity control 16 may permit control of the overall gain of the amplifier stages to prevent extraneous activation of the system in response to low level noises occurring at the premises. A two-stage digital band-pass amplifier 18 may further amplify the output waveform of the amplifier 18 and pass the positive or negative component of a transducer output waveform having a rapid rise time. The band-pass simplification means may amplify output waveforms of the transducer having frequencies within a band centered between 500 and 10,000 hertz.

For the purposes of this disclosure, the term "rapid rise time" when used to describe an audio-electrical or audio-mechanical waveform, refers to the relatively fast increase in amplitude of the audio waveforms associated with sharp noises such as pops, clicks, or the sounds of impact or breaking wood, metal or glass as compared with the relatively slow increases in amplitude associated with, for example, jet aircraft operating at considerable distance from the premises at which the system is installed.

The output signal of the rate of rise detector 20 may be communicated to delay multivibrator 22. Associated with the multivibrator 22 are arm-disarm control 24 and exit delay circuit 26. The control 24 and the delay circuit 26 may be operative to prevent activation of an audible alarm and illuminating device for a preselected interval after the system is enabled to detect audio signals. During this preselected interval, the person who has armed the system may leave the premises without activating the alarm or illumination device with noises he makes while leaving. An alarm duration control 28 may function to deactivate the alarm and illuminating device after a preselected interval following activation of the system by an audio signal. The provision of the alarm duration control permits selection of an interval after which the alarm and illuminating device will be deactivated if the sounds of intrusion have ceased such as in the case where the unauthorized intrusion has been aborted. The delay multivibrator 22 may provide an output to lamp control logic 30 and pulsed oscillator 32 to energize and deenergize the illumination device and to activate and deactivate the audible alarm.

The lamp control logic 30 may be connected to power supply 34 so that a failure of the system's external power source, typically commercial 120V AC electric power, will be indicated by a power outage signal received by the lamp control logic 30. The lamp control logic 30 may be operative to cause the lamp electronic switch 36 to energize an illumination device if the lamp control logic 30 receives either a power outage signal from power supply 34 or an audio detection signal from the delay multivibrator 22. Terminal "A" of the lamp control logic 30 is illustrative of a connection which may be made to the circuit of FIG. 1 to incorporate the radio frequency detector depicted in the block diagram of FIG. 2.

The term "electronic switch" should be construed to embrace all switches capable of being operated by an electronic signal, including but not limited to thyristers, transistors, and electromagnetic switches.

Figure 2:
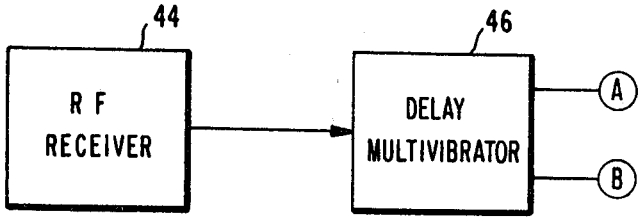
FIG. 2 is a block diagram of a radio frequency alarm detection apparatus which may be incorporated into the embodiment of FIG. 1.

With continued reference to FIG. 1, the pulsed oscillator 32 may receive an audio detection signal from the delay multivibrator 22. The pulsed oscillator may also receive a radio frequency detector signal at terminal B when the radio frequency detector of FIG. 2 is incorporated into the circuit of FIG. 1 as described herein below. Oscillator enable control 38 may permit the pulsed oscillator to be shut down so that no audible alarm will sound in response to sounds impinging on the audio transducer 10. When the pulsed oscillator 32 is activated by the audio detection signal from the delay multivibrator 22, the oscillator provides a signal to audio driver 40 which, in turn, sounds an audible alarm through horn 42.

With reference to FIG. 2, a radio frequency receiver is indicated by the numeral 44. The receiver 44 may provide a signal to delay multivibrator 46 in response to a remotely broadcasted alarm signal. The delay multivibrator 46 may communicate that alarm signal to terminal A of lamp control logic 30 and terminal B of pulsed oscillator 32 shown in FIG. 1.

Figure 3:
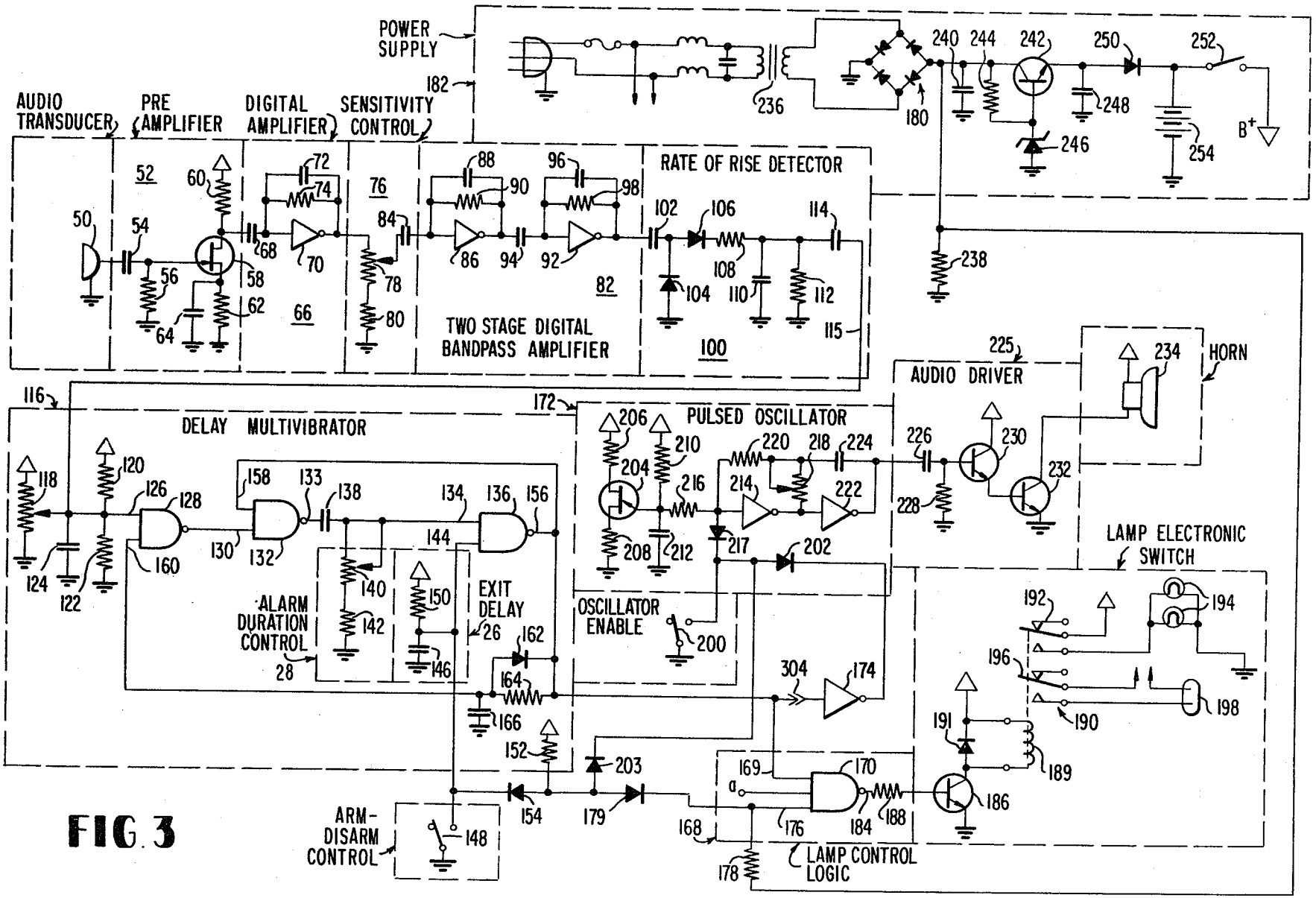
FIG. 3 is a circuit diagram of an embodiment of the intrusion alarm and emergency illumination apparatus of the present invention; and, FIG. 4 is a circuit diagram of a radio frequency alarm detector which may be incorporated into the embodiment of FIG. 3.

Referring now to FIG. 3, a circuit diagram of a second embodiment of the present invention, which embodiment is similar to that of FIG. 1 but in more detail, is shown. In that embodiment an audio transducer or microphone 50 may be connected to preamplifier 52 which may include a coupling capacitor 54 with one terminal connected to the microphone, and the other terminal connected to ground through a resistor 56 and to the gate of a field effect transistor 58. The drain of the field effect transistor may be biased through a resistor 60. The source of the field effect transistor may be grounded through the parallel combination of a resistor 62 and a capacitor 64. The output of the preamplifier may be tapped at the drain of the field effect transistor.

The output of the preamplifier 52 may be communicated to a digital amplifier 66 through coupling capacitor 68. The digital amplifier may include an inverter 70 with an input connected to the coupling capacitor 68 and with a feedback loop comprised of a capacitor 72 in parallel with a resistor 74, connecting the output terminal of the inverter to its input terminal.

The output of the digital amplifier 66 may pass to a sensitivity control 76 which may be comprised of a variable resistance 78 with a first stator connected to the digital amplifier output and with a second stator connected to ground through a fixed resistance 80 to form a variable voltage divider. The wiper of the variable resistance 78 may be connected to a two-stage digital band pass amplifier 82 by a coupling capacitor 84. The band-pass amplification means may amplify output waveforms of the transducer having frequencies within a band centered between 500 and 10,000 hertz.

The signal received by the amplifier 82 may be impressed on the input of an inverter 86, provided with a feedback loop including a capacitor 88 in parallel with a resistor 90. The output of the inverter may be connected to the input of a third inverter 92 through a coupling capacitor 94. The inverter 92 may be provided with a feedback loop comprised of a capacitor 96 in parallel with a resistor 98.

The output of amplifier 82 may be communicated to a rate of rise detector 100. A capacitor 102 may transmit the output of the amplifier 82 to a waveform chopper which may be comprised of a diode 104 connected to ground and diode 106 connected in the signal path. The diodes may be so oriented to shunt negative going portions of the audio-electrical signal produced by the amplifier 82 to ground. A resistor 108 may be connected between the cathode of diode 106 and a parallel combination of capacitor 110 and resistor 112, one end of which combination may be connected to ground. A capacitor 114 may connect the resistors 108 and 112 and the capacitor 110 to delay multivibrator 116.

The output terminal 115 of the rate of rise detector 100 may be connected to the wiper of a variable resistance 118 whose first and second stators are connected to the system's B plus power supply and ground, respectively. The output terminal 115 may also be connected to a bias network comprised of a resistor 120 connected between the B plus power supply voltage and the output terminal, and a resistor 122 connected between the output terminal and ground. A capacitance 124 may be present which may shunt the rate of rise detector output to ground. The output appearing at the terminal 115 may be imposed on a first input 126 of two input NAND gate 128. The output of the NAND gate 128 may be connected to a first input terminal 130 of a second two input NAND gate 132. The output terminal 133 of the NAND gate 132 may be connected to a first input terminal 134 of a third two input NAND gate 136 through duration capacitor 138. The first input terminal 134 of the third NAND gate 136 may be connected to ground through the series combination of a variable resistor 140 and a fixed resistor 142. A second input terminal 144 of the third NAND gate 136 may be connected to ground through capacitor 146 and selectively shorted to ground through a manually operable switch 148. Second input terminal 144 may also be connected to the B plus power supply through a resistor 150 and through the series combination of resistor 152 and diode 154 oriented to pass current induced by the B plus voltage. The output terminal 156 of the third NAND gate 136 may be connected to the second input terminal 158 of the second NAND gate 132 and to the second input terminal 160 of the first NAND gate 128, the latter connection being made through the parallel combination of a resistor 164 and a diode 162 with its cathode connected to terminal 156. The output terminal 156 of the third NAND gate 136 may be shunted to ground through start up delay capacitor 166.

The output of the delay multivibrator 116 may be tapped from the output terminal 156 of the third NAND gate 136 and communicated to a first input terminal 169 of a NAND gate 170 which may comprise lamp control logic 168. (The output of multivibrator 116 may also be communicated to pulsed oscillator 172 through inverter 174.) A second input terminal 176 of the NAND gate 170 may be connected to the output of a diode bridge 180 in the system power supply 182 through resistor 178. The second input terminal 176 may also be connected to the B plus power supply by the resistor 152 in series with a diode 179 whose cathode is connected to terminal 176. Alternatively, fourth NAND gate 170 may be provided with a third input terminal designated by the small letter "*a*" for connection to the radio frequency detector circuit described in connection with FIG. 4. The output terminal 184 of the fourth NAND gate 170 may be connected to the base of a transistor 186 through a resistor 188. Transistor 186 may operate to energize an electromagnet 189 of an electromechanical relay 190. In this configuration, the emitter of the transistor 186 may be connected to ground, and the collector of the transitor may be connected to the B plus voltage through the parallel combination of a reverse biased diode 191 and the coil 189 of the relay electromagnet. A first relay-controlled switch 192 of the relay 190 may be operative to energize lamps 194 when the switch 192 is closed. A second relay-controlled switch 196 may be operative to empower an AC receptacle 198 to operate other accessories plugged into said receptacle.

An oscillating, audio frequency, electronic signal may be provided by pulsed oscillator 172 to facilitate generation of an audible alarm. The pulsed oscillator 172 may be comprised of a unijunction transistor 204 with its base-to-base bias maintained by a resistor 206 connected between the B plus power supply and the first base of the transistor and resistor 208 connected between the second base of the transistor and ground. The emitter of the transistor 204 may be connected to the B plus power supply by resistor 210, connected to ground by capacitor 212, and connected to the input terminal of an inverter 214 through resistor 216. The input terminal of the inverter 214 may also be connected to the anode of the diode 202 and the manually operable switch 200 through a diode 217 with its anode connected to said input terminal of the inverter 214. The pulsed oscillator 172 may be disabled by closing a manually operable switch 200 to ground the cathode of diode 217. When the switch 200 is open, the voltage on the cathode of the diode 217 is determined by the output of the inverter 174 and biasing series combination of diode 203 and resistor 152 connected to the B plus power supply.

A feedback loop is provided for the inverter 214 and consists of variable resistance 218 in series with a fixed resistance 220. The output of the inverter 214 may also be connected to the input of a second inverter 222. A feedback loop for the second inverter 222 may be provided and consist of capacitor 224 connected to the variable resistor 218 and the resistor 220. The output of the pulsed oscillator 172 may be tapped from the output terminal of the second inverter 222.

The output of the pulsed oscillator 172 may be communicated to an audio driver 225 including a coupling capacitor 226 in the signal path and an input resistor 228 shunting the signal path to ground. The output of the pulsed oscillator 172 may be applied to the base of a first transistor 230, in a darlington pair configuration with a second transistor 232, through the capacitor 226. The collector of the transistor 230 may be connected to the B plus power supply and the emitter of that transistor connected to the base of the transistor 232. The emitter of the second transistor 232 may be connected to ground, and a horn or loudspeaker 234 may be connected between the B plus power supply and the collector of the second transistor 232.

The system's power supply 182 may be comprised of a conventional step-down transformer 236 supplying low voltage AC to the conventional full wave bridge 180. The positive output of the full wave bridge may be connected to ground through the parallel combination of resistor 238 and filtering capacitor 240. The positive output of the full wave bridge 180 is regulated by connection to the collector of transistor 242 and to the base of the transistor 242 through bias resistor 244. The voltage on the base of transistor 242 may be held constant by Zener diode 246 connecting the base to ground. Variations in the voltage appearing at emitter of the transistor 242 may be shunted to ground by filter capacitor 248. The regulated positive voltage appearing at the emitter of the transistor 242 may be supplied as the B plus voltage necessary to energize the above-described portions of the circuit through diode 250 and a master on-off switch 252. In the event of a power outage, storage battery 254 may provide the necessary voltage to maintain the system in operative condition.

Figure 4:
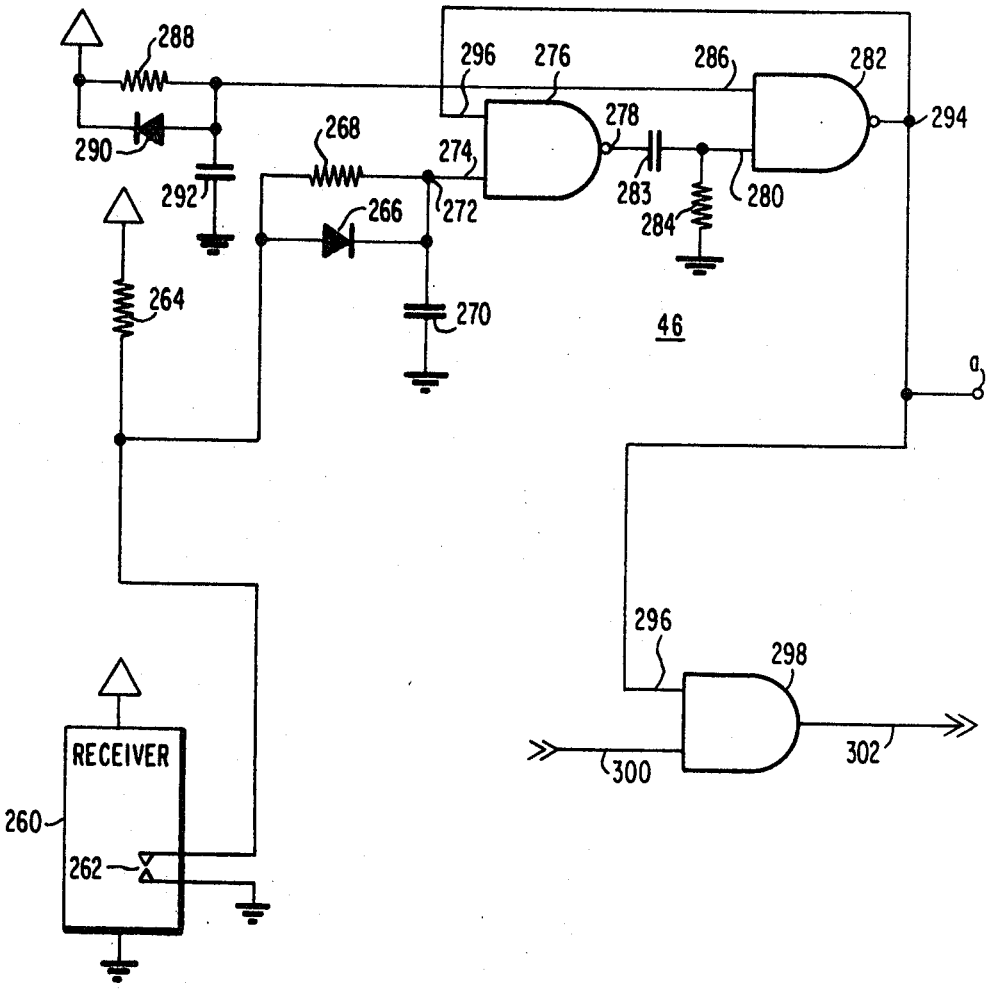

With reference to FIG. 4, a circuit diagram of a radio frequency alarm detector which may be incorporated in the embodiment of FIG. 3 is shown. A radio frequency receiver 260 may function to close contacts 262 in response to reception of a remotely broadcasted alarm signal. The closing of the contacts 262 may serve to short circuit the lower leg of a voltage divider whose upper leg includes a resistor 264 connected to the B plus power supply and whose lower leg consists of the parallel combination of a diode 266 and resistor 268, the combination being connected in series with capacitor 270 to ground. The junction 272 of the resistor 268, the diode 266 and the capacitor 270 may be connected to a first input terminal 274 of a two input NAND gate 276. The output 278 of the NAND gate 276 may be connected to the first input 280 of a second two input NAND gate 282 through a capacitor 283. The first input terminal 280 of the second NAND gate 282 may be grounded through resistor 284. The second input terminal 286 of the second NAND gate 282 may be connected to the B plus power supply by the parallel combination of resistor 288 and diode 290. The input terminal 286 may also be connected to ground by capacitor 292. The output of the NAND gate 282, appearing at terminal 294, may be fed back to a second input 296 of the first NAND gate 276.

The output terminal 294 may be connected at the terminal designated small letter "*a*" in FIG. 3 to incorporate the radio frequency alarm detector into the circuit in FIG. 3. The terminal 294 may also be connected to an input terminal 296 of a two input AND gate 298. Second input terminal 300 and output terminal 302 of the AND gate 298 may be inserted into the circuit of FIG. 3 at the junction designated by the numeral 304 in FIG. 3.

Referring once more to FIG. 1, the operation of the apparatus of the present invention is briefly described. Audio transducer 10, a preamplifier 12, a digital band-pass amplifier 14, sensitivity control 16, two-stage digital band-pass amplifier 18, and rate of rise detector 20, operate in conjunction with one another to produce a d.c. pulse in response to audio-mechanical signals received by the transducer having a frequency, intensity, and rate of rise time characteristic of the sounds of forceable intrusion. The output of the rate of rise detector 20 is applied to the delay multivibrator 22. The delay multivibrator may be operative to energize an illumination device by providing a signal to lamp control logic 30, and may be operative to activate an audible alarm by providing a signal to pulsed oscillator 32.

The delay multivibrator 22 may perform three functions. Multivibrator 22 may prevent erroneous triggering of the audible alarm or illumination device when the system is first turned on. In addition, by virtue of the arm-disarm control 24 and exit delay circuit 26, the system may be armed to provide an audible alarm and/or illumination at some preselected interval after the arm-disarm control is placed in the arm mode. Finally, the alarm duration control 28 permits the selection of the interval during which the illumination device and/or the audible alarm will be activated by a sound impinging on audio transducer 10.

The pulsed oscillator 32 may be activated by a signal from the delay multivibrator 22 in response to which the oscillator will supply an oscillating waveform to the audio driver 40 and horn 42. The pulsed oscillator may be selectively disabled by the oscillator enable control 38, thereby preventing the sounding of the audible alarm.

The apparatus of FIG. 1 may be made responsive to an additional external alarm condition indicator by incorporating the apparatus of FIG. 2 into that of FIG. 1. The RF receiver 44 and the delay multivibrator 46 of FIG. 2 may be connected to the lamp control logic 30 and the pulsed oscillator 32 of FIG. 1 to provide activation of the audible alarm and/or the illumination device in response to a remotely broadcasted, radio frequency, alarm signal.

Referring now to FIG. 3, the operation of the circuit of the present invention may be described in greater detail. Audio transducer 50 may be operative to convert audio-mechanical signals impinging on the transducer to audio-electrical signals which may be amplified by preamplifier 52. The digital amplifier 66 inverts the output waveform of the preamplifier 52 and amplifies audio-electrical signals within a mid-audio frequency band. The latter function is a property of the capacitive and resistive feedback network associated with the inverter. The variable resistor 78 of the sensitivity control 76 permits adjustment of the amplitude of the output signal of the digital amplifier 66 thereby permitting the selection of the intensity of sounds to which the apparatus will respond. Further amplification of the midfrequency band is provided by the two-stage digital band-pass amplifier 82. The rate of rise detector 100 will produce a d.c. output pulse in response to output signals of the digital band-pass amplifier 82 which are of sufficient amplitude and have a sufficient rise time to indicate the occurrence of sounds associated with forceable intrusion on the physical premises.

The operation of the delay multivibrator 116 may be described as follows. At times when no sounds associated with physicial intrusion on the premises are impinging the transducer 50, the input terminal 126 of the NAND gate 128 may be at a low logic level. Hence the output of NAND gate 128 may remain at a high logic level. The first input terminal 134 of the third NAND gate 136 will be held at a low logic level by virtue of the duration capacitor 138. It follows therefore that the output of the third NAND gate 136 may be at a high logic level. This high logic level may be communicated to the first input terminal 169 of the NAND gate 170. Likewise, a high logic level will be communicated to the second input terminal 176 of the NAND gate 170 provided that sufficient line voltage is being supplied to the system to produce a high logic level voltage at the output of the full wave bridge 180. Since both the input terminals of NAND gate 170 are at high logic levels, the output 184 of that gate will remain at a low logic level; thereby, inhibiting the conduction of transistor 186. It may be observed that if there is either a line voltage supply failure or if the output of the NAND gate 136 goes to a low logic level, the transistor 186 may be driven into conduction and consequentially close relay switches 190 and 192 to energize the lamps and the a.c. receptacle 198.

When a sound associated with forceable intrusion impinges on audio transducer 50, a pulse will be transmitted by the rate of rise detector to the delay multivibrator, and, therefore, the first input terminal 126 of the NAND gate 128 may attain a high logic level. At all times when capacitor 166 is charged the second input terminal 160 of the first NAND gate 128 will be at a high logic level. In response to the high logic level appearing at the input terminal 126 the NAND gate 128 may experience a low logic level at its output. This low level output, applied to the first input terminal 130 of the second NAND gate 132, is operative to drive the output of the second NAND gate to a high logic level. This high logic level will be applied directly to the first input terminal 134 of the third NAND gate 136 until such time as the duration capacitor 138 is charged by the high logic level output of the NAND gate 132. The length of time necessary to charge the capacitor 138 will be determined by the resistance selected by adjusting the variable resistance 140. Until such time as the capacitor 138 is charged the high logic level appearing at the first input terminal 134 of the third NAND gate 136 will cause a low logic level at the output 156 of that NAND gate provided that the second input terminal 144 of the third NAND gate is maintained at a high logic level. As will be described below, the latter condition is met when arm-disarm control switch 148 has been opened and sufficient time has passed for the B+ power supply to charge the exit delay capacitor 146.

The low logic level appearing at the output 156 of the third NAND gate 136 in response to sounds associated with physicial intrusion, may be communicated to the NAND gate 170 with the effect of energizing the lamps as above described. The low logic level at output 156 may also be communicated to the inverter 174. Provided that the cathode of the diode 217 is not grounded through the switch 200, a low logic level at output 156 of the third NAND gate 136 will cause the pulsed oscillator 172 to supply an oscillating waveform to the audio driver 255; thereby, sounding an audible alarm.

When the switch 148 is closed, the delay multivibrator will be disarmed because the second input terminal 144 of the third NAND gate 136 will be held at a low logic level. Consequentially, the output 156 of the third NAND gate 136 must remain at a high logic level. As described above, such a high logic level may not activate either the illumination devices or the audible alarm. The switch 148 may be opened to arm the delay multivibrator after a preselected interval. The opening of the switch 148 permits the B plus power supply to charge the exit delay capacitor 146 through resistors 150 and 152. Once the exit delay capacitor 146 has charged, a high logic level will be applied to the second input terminal 144 of the third NAND gate 136. Upon the coincidence of a high logic level at the first input terminal 134 of the third NAND gate 136, the output of the NAND gate 136 will be driven to a low logic level. This low logic level may be operative to activate the audible alarm and/or energize the illumination device.

The circuit of FIG. 4 may be incorporated into the circuit of FIG. 3 to provide activation of the audible alarm and/or energization of the illumination device in response to the reception of a remotely broadcasted radio frequency signal. The circuit of FIG. 4 is operative to provide a switching logic level in response to the closure of the contacts 262 of the radio frequency receiver 260, which may be caused by a remotely broadcasted signal. The closure of the contacts 262 in response to such a broadcasted signal imposes a low logic level at the input terminal 274 of the NAND gate 276. Since, in the absence of such a radio frequency signal, the second input terminal 296 of the NAND gate 276 is maintained at a high logic level, the closure of the contacts 262 have the effect of changing the logic level at the output 278 of the NAND gate 276 from a low to a high stage. This high logic level is reflected through capacitor 283 to the first input 280 of the NAND gate 282 until the capacitor has charged. Since the second input 286 of the NAND gate 282 is always maintained at a high logic level after the system is started up, the change in state at the input terminal 280 causes the level at the output 294 of the NAND gate 282 to change from a high to a low logic level. In an embodiment of the present invention where the NAND gate 170 shown in FIG. 3 is a three input NAND gate rather than a two input NAND gate, the output terminal 294 of the NAND gate 282 may be connected to the third input terminal of the NAND gate 170 designated "*a*".

When the circuit of FIG. 4 is incorporated into the circuit of FIG. 3 in the aforementioned manner either a remotely broadcasted radio frequency alarm signal, the sounds associated with physical intrusion impinging on the audio transducer, or a power outage will cause a high logic level to appear at the output 184 of the NAND gate 170 thereby energizing the lamps 194 and the a.c. receptacle 198. The circuit of FIG. 4 may also be operative to activate the audible alarm when the output 294 of the NAND gate 282 is connected to an input terminal 296 of the AND gate 298. If the second input terminal 300 and output terminal 302 of the AND gate are inserted in line at the junction 304 of the circuit in FIG. 3, a low logic level appearing at the output terminal 294 of the NAND gate 282 may cause the generation of an oscillating waveform by the pulsed oscillator 172 which in turn will cause the audible alarm sound. In this configuration the audible alarm will be activated either by reception of sounds associated with physical intrusion by the audio transducer 50 or by reception of a remotely broadcasted radio frequency alarm signal by the receiver 260.

In the exemplary circuit of FIG. 3, the values of the various circuit components may be as follows:

| | |
|---|---|
| Resistor 56 | 2.2 M ohms |
| Transistor 58 | 2N4222A or 2N3704 |
| Resistor 60 | 10 K ohms |
| Resistor 62 | 4.7 K ohms |
| Capacitor 64 | .1 Microfarads |
| Capacitor 68 | .01 Microfarads |
| Inverter 70 | CD4049AE |
| Capacitor 72 | .001 Microfarads |
| Resistor 74 | 1 M ohms |
| Variable Resistor 78 | 1 M ohms |
| Resistor 80 | 10 K ohms |
| Capacitor 84 | .01 Microfarads |
| Inverter 86 | CD4049AE |
| Capacitor 88 | .001 Microfarads |
| Resistor 90 | 1 M ohms |
| Capacitor 94 | .01 Microfarads |
| Inverter 92 | CD4049AE |
| Capacitor 96 | .001 Microfarads |
| Resistor 98 | 1 Ohm |
| Capacitor 102 | .1 Microfarads |
| Resistor 108 | 20 K ohms |
| Capacitor 110 | .1 Microfarads |
| Resistor 112 | 1 M ohms |
| Capacitor 114 | .1 Microfarads |
| Variable Resistor 118 | 1 M ohms |
| NAND gates 128, 132 & 136 | CD4011AE |
| Capacitor 138 | 250 Microfarads |
| Variable Resistor 140 | 1 M ohms |
| Resistor 142 | 10 K ohms |
| Capacitor 146 | 50 Microfarads |
| Resistor 150 | 100 K ohms |
| Resistor 152 | 100 K ohms |
| Resistor 164 | 1 M ohms |
| Capacitor 166 | 2.2 Microfarads |
| NAND gate 170 | CD4011AE |
| Inverter 174 | CD4049AE |
| Resistor 178 | 1 M ohms |
| Transistor 204 | 2N4870 |
| Resistor 206 | 470 Ohms |
| Resistor 208 | 220 Ohms |
| Resistor 210 | 140 K ohms |
| Capacitor 212 | 2.2 Microfarads |
| Resistor 216 | 3.3 M ohms |
| Inverters 214 & 222 | CD4049AE |
| Resistor 220 | 1 M ohms |
| Variable Resistor 218 | 4.7 K ohms |
| Capacitor 224 | .1 Microfarads |
| Capacitor 226 | 2.2 Microfarads |
| Resistor 228 | 10 K ohms |
| Transistor 230 | 2N3704 or MPS3704 |
| Transistor 232 | 2N6412 |
| Transistor 186 | 2N3704 or MPS3704 |

The principles, preferred embodiments and modes of operation of the present invention have been described in the foregoing specification. The invention which is intended to protected is not, however, to be construed as limited to the particular forms disclosed, since these are to be regarded as illustrative rather than restrictive.

Variations and changes may be made by those skilled in the art without departing from the spirit and scope of the present invention.

What is claimed is:

1. An intrusion alarm and emergency illumination apparatus comprising:
   an audible alarm;
   an illumination device;
   means for detecting sounds with waveforms having a relatively fast increase in amplitude as is associated with sharp noises such as pops, clicks, and the sounds of impact or breaking of wood, metal or glass and for producing an output signal in response thereto; and,
   circuit means for energizing said illumination device and sounding said audible alarm in response to said output signal.

2. A method of providing an alarm on the occurrence of human intrusion into a physical structure comprising the steps of:
   (a) converting ambient audio-mechanical signals to audio-electrical waveforms;
   (b) detecting audio-electrical waveforms having a relatively fast increase in amplitude as is associated with sharp noises such as pops, clicks, and the sounds of impact or breaking of wood, metal or glass as may be caused by human intrusion into a structure; and,
   (c) producing a perceptible alarm in response to the detection.

3. In an audio-actuated switch for controlling current through an electrical device including an audio transducer and means for amplifying the output of said transducer to provide an output waveform used to trigger an electronic switch in response to sound, the improvement wherein the means for amplifying the output waveform of the transducer includes a digital band-pass amplifier comprising:
   an inverter; and,
   a feedback loop connected to said inverter having a capacitive element in parallel with a resistive element.

4. In an audio-actuated switch for controlling current through an electrical device, which audio-actuated switch includes an audio transducer whose output waveform is amplified and an electronic switch triggered by said amplified waveform in response to sound, the improvement wherein said audio-actuated switch comprises means solely responsive to amplified transducer output waveforms having a relatively fast increase in amplitude as is associated with sharp noises such as pops, clicks, and the sounds of impact and breaking of wood, metal or glass.

5. An apparatus for detecting sounds associated with human intrusion into a physical structure comprising:
   an audio transducer for producing an electrical output waveform in response to sound;
   a band-pass amplification means for amplifying output waveforms of said transducer; and,
   means for producing sound detection indicia in response to amplified output waveforms having a relatively fast increase in amplitude as associated with sharp noises such as pops, clicks, and the sounds of impact and breaking of wood, metal or glass such as may be caused by a human intruding into a physical structure.

6. The apparatus of claim 5 wherein said band-pass amplification means amplifies output waveforms of said transducer having frequencies within a band centered between 500 and 10,000 hertz.

7. An intrusion alarm and emergency illumination apparatus comprising:
   an audible alarm;
   an illumination device;
   an audio transducer for producing output waveforms in response to sounds;
   a band-pass amplifier to amplify output waveforms of said transducer;
   discriminating means for detecting amplified transducer output waveforms having a rapid rise time and for producing an output signal in response thereto;
   radio frequency detection means for detecting a remotely broadcasted, radio frequency alarm signal and for producing an output signal in response thereto;
   circuit means for energizing said illumination device during power outages, and for energizing said illumination device and activating said alarm in response to the output signal of said discriminating means or the output signal of said radio frequency detection means.

8. The apparatus of claim 7 wherein said circuit means includes means for selectively disabling said audible alarm so that only said illumination device is energized in response to the output signal of said discriminating means or the output of said radio frequency detection means.

9. The apparatus of claim 7 wherein said circuit means is operative to deactivate said audible alarm and deenergize said illumination device after a preselected interval following activating of said audible alarm and the energizing of said illumination device in response to the output signal of said discriminating means.

10. The apparatus of claim 9 wherein said circuit means includes:
   a logic circuit including logic gates wired in the configuration of a monostable multivibrator;
   a first electronic switch for activating and deactivating said alarm in response to a switching output of said logic circuit; and,
   a second electronic switch for energizing and deenergizing said illumination device in response to a switching output of said logic circuit.

11. The apparatus of claim 10 wherein said circuit means further includes means for preventing activation of said alarm for a second preselectable time interval after the alarm system is enabled to detect audio signals.

12. The apparatus of claim 11 wherein said activation preventing means includes a first capacitor which reaches an alarm enabling voltage after the second preselectable interval; and,
   wherein said logic circuit includes:
      a second capacitor which reaches an alarm deactivating voltage after the alarm has been activated for the first-recited preselectable interval, and
      a first logic gate producing a switching output in response to the voltages on said capacitors.

13. The apparatus of claim 12 wherein said logic gate is a NAND gate with a first input terminal connected to said first capacitor and a second input terminal connected to said second capacitor; and
   wherein said circuit means includes a second logic gate for producing a switching output for energizing said illumination device in response to either the output signal of said discriminating means or a power outage.

14. The apparatus of claim 12 wherein said logic gate is a NAND gate with a first input terminal connected to said first capacitor and a second input terminal connected to said second capacitor; and wherein said circuit means includes a second logic gate for producing a switching output for energizing said illumination device in response to either the output signal of said discriminating means or a power outage.

15. An intrusion alarm apparatus comprising:

detecting means for producing an output signal in response to an audio signal;

an audible alarm; and, circuit means for activating said alarm in response to the output signal of said detecting means and for deactivating said alarm after a preselected interval following activation of said alarm comprising:

a logic circuit including logic gates wired in the configuration of a monostable multivibrator, and an electronic switch for activating and deactivating said alarm in response to a switching output of said logic circuit.

16. The apparatus of claim 15 wherein said circuit means further comprises means for preventing activation of said alarm for a second preselectable interval after the alarm system is enabled to detect audio signals.

17. An intrusion alarm apparatus comprising:

detecting means for producing an output signal in response to an audio signal;

an audible alarm;

circuit means for activating said alarm in response to the output signal of said detecting means and for deactivating said alarm after a first preselected interval following activation of said alarm comprising:

a logic circuit including logic dates wired in the configuration of a monostable multivibrator, and an electronic switch for activating and deactivating said alarm in response to a switching output of said logic circuit;

said circuit means further comprising means for preventing activation of said alarm system for a second preselectable interval after the alarm system is enabled to detect audio signals and including a first capacitor which reaches an alarm enabling voltage after the alarm system has been enabled for the second predistable interval, and wherein said logic circuit further comprises:

a second capacitor which reaches an alarm deactivating voltage after the alarm has been activated for the said first preselected interval, and a logic gate producing a switching output in response to the voltages on said capacitor.

18. The apparatus of claim 17 wherein said logic gate is a NAND gate with a first input terminal connected to said first capacitor and a second input terminal connected to said second capacitor; and, wherein said first-recited preselectable interval is determined by selecting an impedance through which said second capacitor is charged in response to the output signal of said detecting means.

* * * * *